US005310011A

United States Patent [19]

Kaakkurivaara

[11] Patent Number: 5,310,011

[45] Date of Patent: May 10, 1994

[54] VERTICAL DRILLING BOOM

[75] Inventor: Jouko Kaakkurivaara, Vuorentausta, Finland

[73] Assignee: Tamrock Oy, Tampere, Finland

[21] Appl. No.: 955,720

[22] PCT Filed: Jun. 17, 1991

[86] PCT No.: PCT/FI91/00189

§ 371 Date: Dec. 21, 1992

§ 102(e) Date: Dec. 21, 1992

[87] PCT Pub. No.: WO92/00439

PCT Pub. Date: Jan. 9, 1992

[30] Foreign Application Priority Data

Jun. 28, 1990 [FI] Finland ..... 903284

[51] Int. Cl.[5] ..... E21B 15/04

[52] U.S. Cl. ..... 173/194; 173/28; 173/44

[58] Field of Search ..... 173/31, 32, 33, 34, 173/35, 36, 37, 144, 145, 28, 185, 193, 194, 141, 44

[56] References Cited

U.S. PATENT DOCUMENTS

| | | | |
|---|---|---|---|
| 2,614,808 | 10/1952 | Curtis et al. | 173/37 X |
| 3,375,880 | 4/1968 | Pyles et al. | 173/37 |
| 3,459,394 | 8/1969 | Kimber | 248/2 |
| 3,951,216 | 4/1976 | Crawshay et al. | 173/36 X |
| 3,980,142 | 9/1976 | Grigoriev et al. | 173/43 |
| 4,039,032 | 8/1977 | Morrison | 173/43 |
| 4,158,520 | 6/1979 | Prebensen | 173/31 X |
| 4,298,073 | 11/1981 | Yates | 173/185 X |
| 4,420,277 | 12/1983 | Hibbärd et al. | 173/32 X |
| 4,890,680 | 1/1990 | Porsfeld | 173/185 X |

FOREIGN PATENT DOCUMENTS

| | | |
|---|---|---|
| 830008 | 7/1983 | Finland . |
| 67605 | 12/1984 | Finland . |
| 68295 | 4/1985 | Finland . |

*Primary Examiner*—Rinaldi Rada
*Attorney, Agent, or Firm*—Nixon & Vanderhye

[57] ABSTRACT

A vertical drilling boom for a rock drilling equipment includes a vertical boom (2) mounted at its lower end turnably about a horizontal shaft (6) with respect to a carrier (1) of the rock drilling equipment. The vertical boom (2) comprises two boom portions (2*a*, 2*b*) mounted longitudinally slideably with respect to each other and an actuating device (2*c*) for displacing the boom portions (2*a*, 2*b*) with respect to each other to adjust the length of the boom (2). An actuating device (7*a*, 7*b*) for turning the boom (2) about the shaft (6) and a boom head (3) for turning a feeding beam (12) of a rock drilling machine mounted to the boom (2) about a shaft (5) transverse, preferably perpendicular, to the longitudinal axis of the boom (2) are provided. Motors (5*a*, 5*b*) are provided for turning the boom head (3). Pressure fluid for operating the rock drilling machine and actuating devices associated with it is passed from the carrier (1) to the rock drilling machine and its actuating devices and back to the carrier (1) through conduits (16*a* to 18*a*, 16*b* to 18*b*) leading through the boom head (3) of the vertical boom (2).

6 Claims, 3 Drawing Sheets

VERTICAL DRILLING BOOM

BACKGROUND OF INVENTION

The invention relates to a vertical drilling boom for a rock drilling equipment comprising a vertical boom mounted at its lower end turnably about a horizontal shaft with respect to a carrier of the rock drilling equipment, the vertical boom comprising two boom portions mounted longitudinally slideably with respect to each other and an actuating device for displacing the boom portions with respect to each other to adjust the length of the boom; at least one actuating device for turning the boom about the shaft; a boom head for turning a feeding beam of a rock drilling machine mounted to the boom about a shaft transverse, preferably perpendicular, to the longitudinal axis of the boom; and means for turning the boom head.

On drilling so-called production holes parallel with each other in a rock, especially in tunnels, so as to systematically blast off material to be excavated, it is customary to use a vertical drilling boom for carrying out the drilling process. The vertical drilling boom is a vertical boom the lower end of which is mounted in the drilling equipment turnably about a horizontal axis in such a way that the upper end of the boom can be turned along a curved path with respect to the drilling equipment. At the upper end of the vertical boom there is provided a swing joint the shaft of which is parallel to the shaft of the lower end of the boom and to which the drilling boom is connected by means of a so-called Herculean joint. The Herculean joint is provided with an arm attached to the swing joint of the upper end of the boom, the other end of the arm being attached to the feeding beam of the drilling machine turnably about an axis parallel to the turning axis in such a way that when the vertical boom is tilted, the feeding beam is maintained in the same direction and in the same position in the longitudinal direction of the feeding beam with respect to the joint of the lower end of the vertical boom, and, as a result, with respect to the rock to be drilled.

The use of the Herculean joint has many disadvantages due to its complicated construction and the great number of joints. The displacement of the feeding beam from hole to hole is complicated for the operator and the displacement is very difficult to automate as the arrangement would require several sensors and adjusting devices which have to be controlled. A further disadvantage is that the solution requires several actuating devices to which a great number of pressure fluid hoses has to be drawn, whereby the provision of the required hoses is difficult to realize in such a way that all the required positions of the boom are possible. As a result, the arrangement involves large bunches of hoses and the dimension of the vertical boom in the direction of the turning axis is large so that the dimensions of the equipment will be unnecessary large.

SUMMARY OF THE INVENTION

The object of the present invention is to provide a vertical boom which avoids the above disadvantages and which is simpler in construction and easier to realize and which can be easily controlled during drilling both manually and automatically. A vertical boom of the invention is characterized in that pressure fluid for operating the rock drilling machine and actuating devices associated with it is passed from the carrier to the rock drilling machine and its actuating devices and back to the carrier through conduits leading through the boom head of the vertical boom.

BRIEF DESCRIPTION OF THE DRAWING FIGURES

The invention will be described in greater detail in the attached drawings, in which FIGS. 1*a* and 1*b* illustrate a vertical drilling boom according to the invention when mounted in a drilling equipment;

FIGS. 2*a* to 2*c* illustrate the vertical boom according to the invention in different positions along its path; and FIG. 3 is a schematic cross-sectional view of the passage of hydraulic conduits through a boom head.

DESCRIPTION OF A PREFERRED EMBODIMENT OF THE INVENTION

Figure 1A:
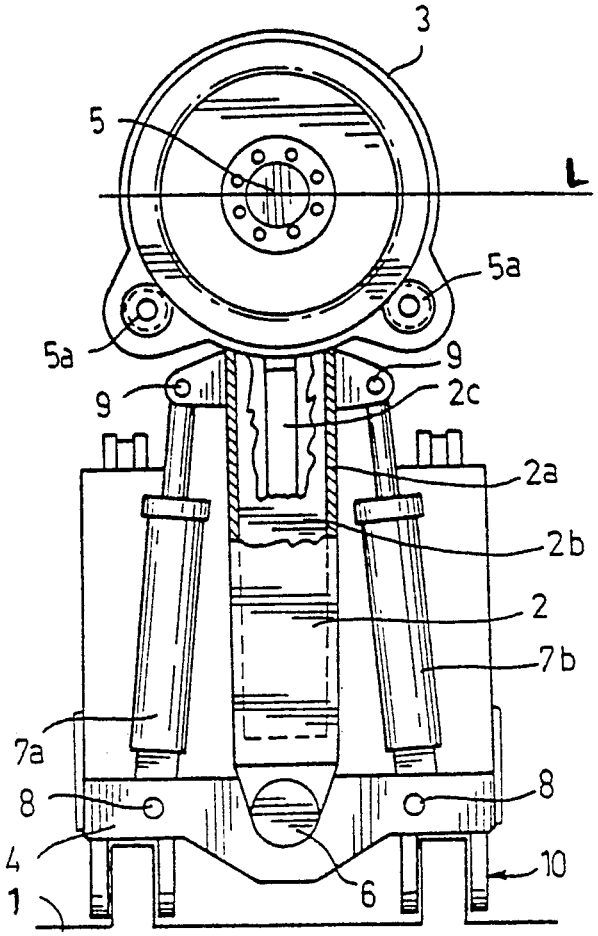
Figure 1B:
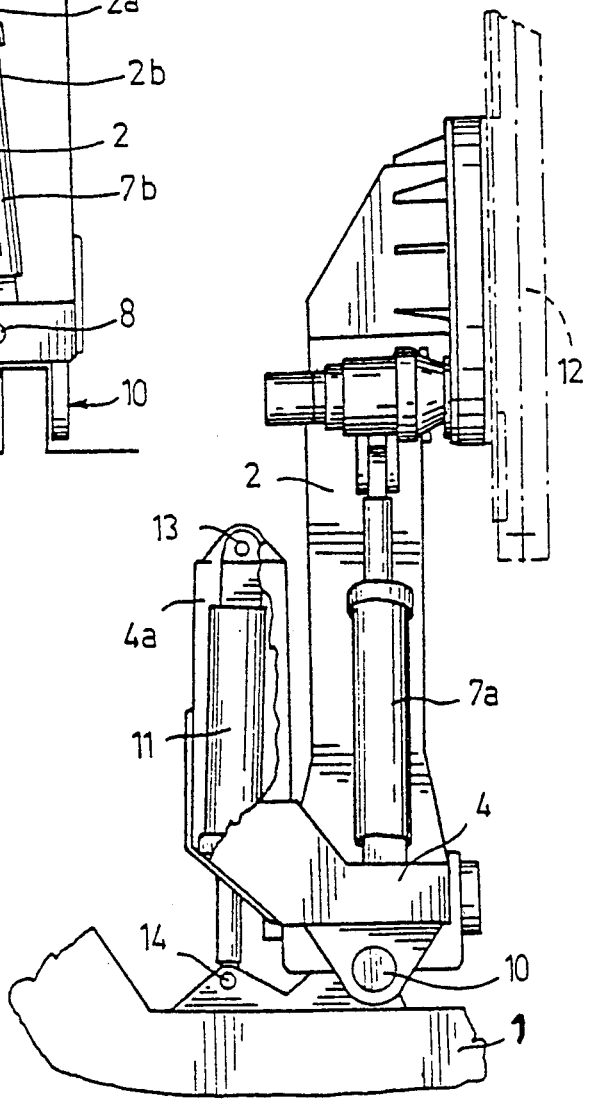

In FIGS. 1*a* and 1*b*, a vertical drilling boom 2 is mounted in a carrier 1. A boom head 3 forming a swing joint is provided at the upper end of the vertical boom. The vertical boom 2 is pivotably mounted in an auxiliary frame 4 with respect to the auxiliary frame about a shaft 6 transverse, usually perpendicular, to the longitudinal axis of the vertical boom 2 and parallel to a shaft 5 of the boom head 3. The boom head comprises two hydraulically operated motors 5*a* by means of which the boom head can be rotated about its shaft 5. Actuating means, that is hydraulic cylinders 7*a* and 7*b* are provided at the sides of the vertical boom 2. The ends of the cylinders are hinged to the auxiliary frame 4 rotatably about shafts 8 parallel to the shaft 6, and their piston rods are correspondingly hinged to the vertical boom 2 by means of shafts 9 parallel to the shafts 8 in such a way that the vertical boom 2 can be turned about the shaft 6 by varying the length of the cylinders. The auxiliary frame 4 in turn is hinged to the carrier 1 of the drilling equipment by means of a shaft 10 perpendicular to the shaft 6, and it comprises hydraulic cylinders 11 between the carrier 1 of the drilling equipment and the auxiliary frame 4. The hydraulic cylinders 11 are hinged to the driling equipment and correspondingly to the auxiliary frame 4 by means of shafts parallel to the shaft 10. By varying the length of the cylinders 11 the auxiliary frame 4 and thus the vertical boom 2 can be turned about the shaft 10. A feeding beam 12 for a rock drilling machine is mounted directly to the boom head 3 of the vertical boom so that it can be rotated about the shaft 5 in a direction transverse to the longitudinal axis of the vertical boom 2, preferably in a plane defined by the vertical axis.

FIG. 1*b* shows the vertical boom of FIG. 1*a* as seen in the direction of the shaft 10. The auxiliary frame 4 is provided with tilt arms 4*a* to which one end of the cylinders 11 is attached rotatably about a shaft 13 parallel to the shaft 10, the piston rods of the cylinders being attached at the other end rotatably about a shaft 14 parallel to the shaft 10. By varying the length of the cylinder 11, the vertical boom 2 can be turned about the shaft 10, so that holes can be drilled with a desired inclination advantageous in view of the production.

The vertical boom 2 is formed by a sleeve-like body 2*a* within which a boom beam 2*b* is mounted movably with respect to it in the longitudinal direction of the vertical boom. A hydraulic cylinder 2*c* is provided between the body 2*a* and the boom beam 2*b*, preferably inside the boom beam 2*b*. One end of the hydraulic cylinder 2c is attached to the body 2a and the other end to the boom beam 2b for displacing the boom beam 2b with respect to the body 2a.

Figure 2A:
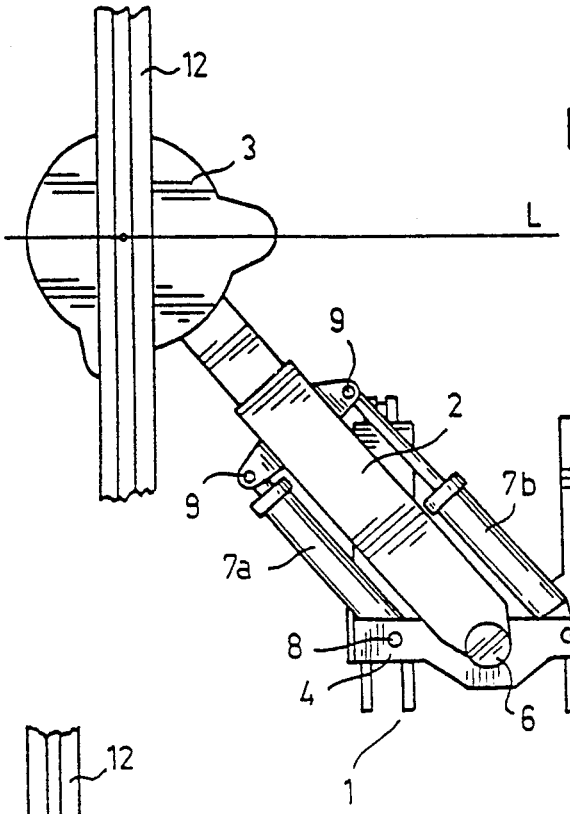
Figure 2B:
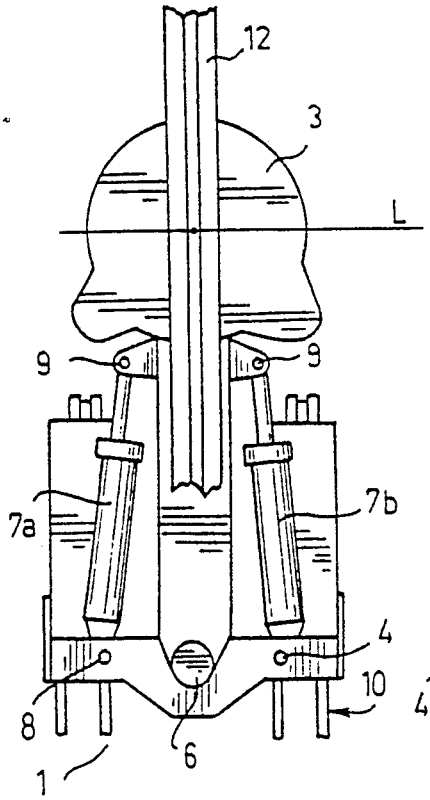
Figure 2C:
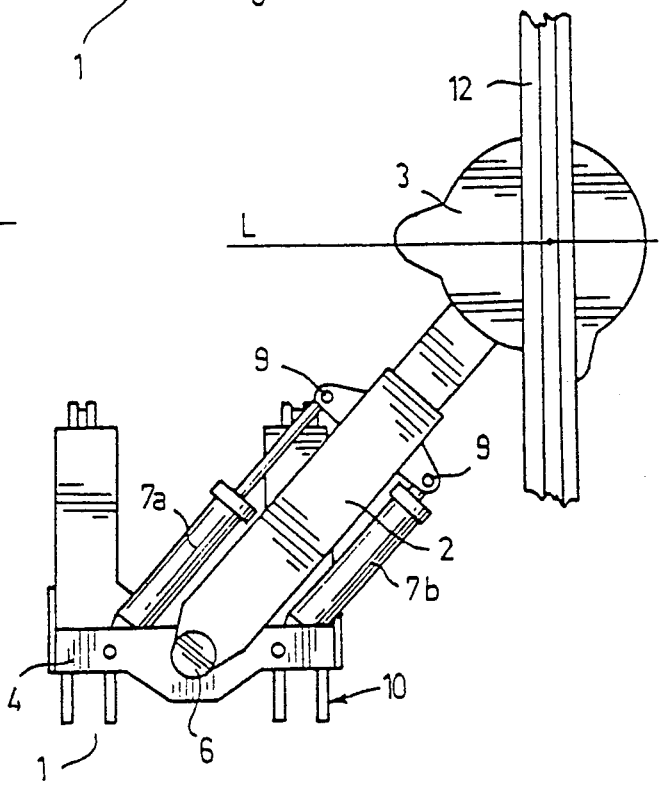

FIGS. 2a to 2c show how the vertical boom 2 operates when holes with a constant depth and a predetermined mutual spacing are to be drilled in a predetermined direction. In FIG. 2a, the vertical boom 2 is tilted to its extreme position, to the left in the figure, so that the left-hand side cylinder 7a is at its shortest and the right-hand side cylinder 7b at its longest. The cylinder 2c within the vertical boom 2 is also at its longest and the boom beam 2b projects from the body 2a as far as is possible to it. The shaft 5 of the boom head 3 is thereby on a line L and in the case of the figure the feeding beam 12 extends in the vertical direction, so that the hole opens perpendicularly downwards. When the feeding beam 12 is displaced after the drilling of the first hole to the following hole, the vertical boom 2 is tilted by means of the cylinders 7a and 7b to the right in the figure while the cylinder 2c is shortened, so that the boom beam 2b is displaced within the body 2a and the turning shaft 5 of the boom head 3 moves all the time along the line L, as shown in FIG. 2b. In FIG. 2b, the vertical boom 2 is perfectly upright, so that the cylinder 2c is at its shortest and the boom beam 2b is fully retracted within the body 2a. When the vertical boom 2 turns about the shaft 6, the shaft 5 of the boom head is correspondingly turned by the motors 5a so that the feeding beam 12 always remains in the same direction, that is, in this particular case, in the vertical direction, as shown in FIG. 2a. When the feeding beam is displaced from the position shown in FIG. 2b to the other extreme position shown in FIG. 2c, the vertical boom 2 is tilted by means of the cylinders 7a and 7b while the boom beam 2b is again pushed by means of the cylinder 2c outwards from the body 2a so that the shaft 5 of the boom head 3 still remains on the line L, the feeding beam 12 being turned by the boom head 3 about the shaft 5 in such a way that its direction remain unchanged all the time. As the turning shaft 5 remains all the time on the same line, the end point of the hole to be drilled by the drilling device is always on the same line so that the excavation takes place in a desired, controlled manner. The construction of the vertical boom and the relative movements between its parts have been described above. Being obvious to one skilled in the art on the basis of the above description, the realization of the hydraulic connections between the actuating means or any other control connections has not been described.

Figure 3:
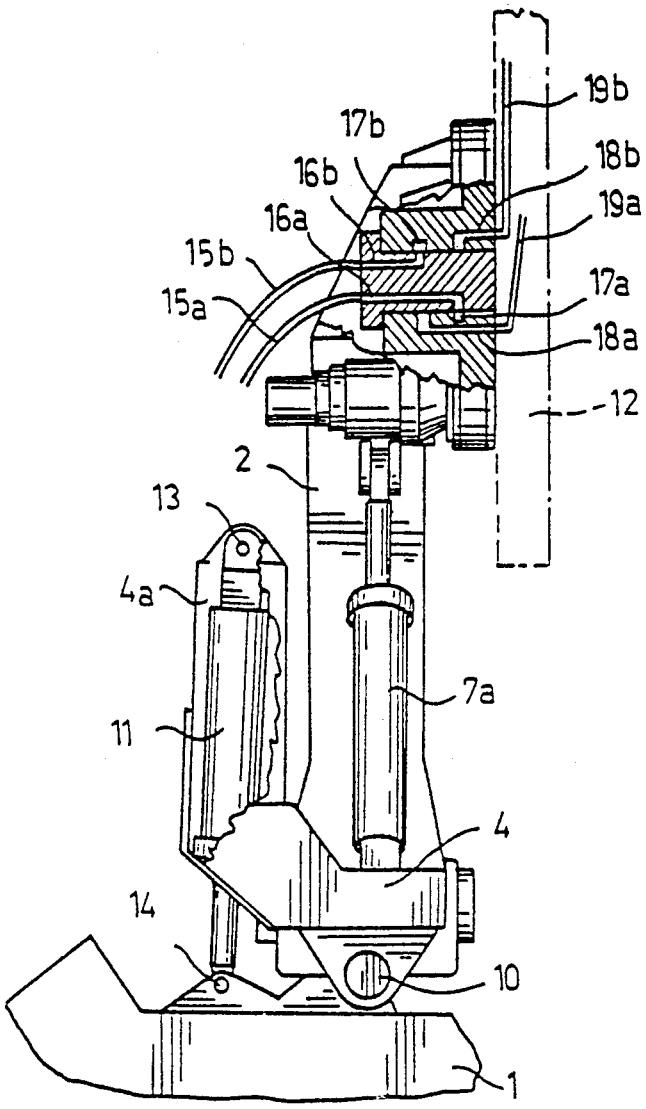

FIG. 3 shows a schematic cross-sectional view of the boom head 3 and the passage of hydraulic conduits through the boom head 3 in such a way that the boom head 3 can be freely rotated about the shaft 5 without any risk of the hoses or conduits being entangled. This is realized in such a way that hydraulic hoses 15a and 15b from the carrier of the drilling equipment are passed to the end of the shaft 5 and connected to conduits 16a and 16b extending in the shaft 5. The other end of each conduit 16a and 16b on the outside of the shaft is so positioned with respect to the boom head 3 that each end will be positioned in alignment with its own separate annular groove 17a and 17, respectively, formed in the boom head 3. A new conduit 18a and 18b, respectively, leads from each groove to the front surface of the boom head 3, at which the conduits are connected to hoses 19a and 19b leading to the feeding beam and the feeding machinery of the drilling machine and to the drilling machine. The hoses 15a and 15b and 19a and 19b are connected to the ends of the respective conduits in a manner known per se by means of nipples. The annular grooves 17a and 17b are sealed to the shaft 5 on both sides in a manner known per se by means of ring-shaped seals not shown in the figure, to keep the conduits apart from each other so that they will not affect each other. The hydraulic hose 15a and 15b for each specific actuating means thereby continuously communicates only with the respective actuating means through the hose 19a and 19b, respectively, extending from the front surface of the boom head 3, so that the actuating means can be controlled in a conventional manner. The introduction of pressure fluid through a rotating hub or shaft as described above is known per se, and will therefore not be described in detail.

The invention has been described above and in the attached drawings by way of example and it is in no way restricted to them. The construction of the vertical boom and the construction and operation of the boom head may deviate in many ways from those described above. It is not necessary to be able to tilt the vertical boom in all directions but it is sufficient that it can be tilted in a plane defined by the turning axis of the boom head, so that the turning axis and, as a result, the position of the feeding beam and the hole to be drilled can be brought in the same plane by varying the relative position of the boom parts with respect to each other in the longitudinal direction of the boom. Even though only two hoses are shown to extend through the boom head in FIG. 3, the number of hoses may be greater; in practice, the number will be greater as all hoses required for the operation of the drilling machine and the operation of the actuating means associated with the drilling process can be easily and simply passed from the carrier of the drilling equipment to the feeding beam and further to the actuating means. In this way the hoses can be protected also on the side of the feeding beam of the drilling machine, as they can be passed from the boom head onwards in a space formed within the feeding beam, being thus completely protected from the surroundings. It is not necessary to pass the hoses through the boom head; it is, however, of great advantage as shorter hoses can thereby be used and the hoses are less liable to rubbing, entanglement and wear and the risk of the hoses being damaged is reduced.

I claim:

1. A vertical drilling boom for rock drilling equipment, comprising:

a frame;

a vertical boom pivotally mounted at its lower end to said frame for pivoting movement about a generally horizontal axis and having a longitudinal axis;

said vertical boom including two boom portions longitudinally slidable relative to one another and a first actuating device for displacing the boom portions relative to one another to adjust the length of the boom;

a second actuating device for pivoting the boom about the horizontal axis;

a boom head carried by said boom for rotating a feeding beam of rock drilling equipment mounted to the boom about a shaft having a transverse axis perpendicular to the longitudinal axis of the boom; and means for rotating the boom head about said shaft;

said boom head including pressure fluid lines extending therethrough for transmitting pressure fluid to the rock drilling equipment.

2. A vertical drilling boom according to claim 1 wherein said pressure lines include a first pair of conduits formed in said shaft, said conduits extending to an outer surface of the shaft at one end thereof, said boom head including a housing surrounding said shaft and having a second pair of conduits extending from an inner surface of said housing adjacent sides of the shaft to a front surface of the boom head housing opposite said one end of said shaft such that pressure fluid hoses leading to the rock drilling machine can be connected to the second pair of conduits of the housing, and annular grooves between the shaft and the boom head housing so that the first pair of conduits in the shaft communicate with the respective second pair of conduits in the boom head housing at all rotational positions of the boom head.

3. A vertical drilling boom according to claim 2 wherein the annular grooves are formed on the inner surface of said boom head.

4. A vertical drilling boom according to claim 3 wherein said first actuating device is arranged to adjust the length of the boom such that when the boom is pivoted about the horizontal axis, the length of the boom changes in proportion to the pivot angle of the boom so that said shaft of the boom head remains substantially on a straight line regardless of the pivot angle of the boom.

5. A vertical drilling boom according to claim 2 wherein said first actuating device is arranged to adjust the length of the boom such that when the boom is pivoted about the horizontal axis, the length of the boom changes in proportion to the pivot angle of the boom so that said shaft of the boom head remains substantially on a straight line regardless of the pivot angle of the boom.

6. A vertical drilling boom according to claim 1 wherein said first actuating device is arranged to adjust the length of the boom such that when the boom is pivoted about the horizontal axis, the length of the boom changes in proportion to the pivot angle of the boom so that said shaft of the boom head remains substantially on a straight line regardless of the pivot angle of the boom.

* * * * *